US011098866B1

(12) United States Patent
Li

(10) Patent No.: US 11,098,866 B1
(45) Date of Patent: Aug. 24, 2021

(54) SOLAR CELL BOX FOR COLOR LIGHTS

(71) Applicant: Taizhou Wanchang Electronic Technology Co., Ltd., Linhai (CN)

(72) Inventor: Jichang Li, Linhai (CN)

( * ) Notice: Subject to any disclaimer, the term of this patent is extended or adjusted under 35 U.S.C. 154(b) by 0 days.

(21) Appl. No.: 17/082,119

(22) Filed: Oct. 28, 2020

(51) Int. Cl.
*F21S 9/03* (2006.01)
*F21V 31/00* (2006.01)
*F21V 21/08* (2006.01)

(52) U.S. Cl.
CPC ..... *F21S 9/037* (2013.01); *F21V 31/005* (2013.01); *F21V 21/0824* (2013.01)

(58) Field of Classification Search
CPC ..... F21V 31/005; F21V 31/00; F21V 21/0824
See application file for complete search history.

(56) References Cited

U.S. PATENT DOCUMENTS 9,571,032 B2 2/2017 Son
2010/0108376 A1* 5/2010 Richter ..... H01R 13/6641 174/548
2012/0266934 A1 10/2012 Tang et al.
2012/0298189 A1 11/2012 Sasakura
2015/0211694 A1* 7/2015 Camenzuli ..... F21L 4/08 362/183
2019/0137056 A1* 5/2019 Sreshta ..... F21V 23/0435

FOREIGN PATENT DOCUMENTS

CN 205566161 U 9/2016
CN 210092180 U 2/2020

* cited by examiner

*Primary Examiner* — Anabel Ton
(74) *Attorney, Agent, or Firm* — Erson IP (Nelson IP)

(57) ABSTRACT

The present invention discloses a solar cell box for color lights, and aims at providing a solar cell box for color lights with high structural rationality, simple structure and good waterproof effect. Key points of the technical solution of the present invention are as follows: by separating a mounting area of a solar charging panel from a mounting area of cells, the assembling thickness can be effectively reduced, and the transportation expense can be controlled within a reasonable range, so that the transportation cost is reduced. A solar charging panel part is staggered to a lithium cell mounting part, so that the safety can also be improved accordingly, the practicability is high, and the structure is simple. The present invention is applicable to the technical field of power supply apparatuses for color lights.

6 Claims, 3 Drawing Sheets

SOLAR CELL BOX FOR COLOR LIGHTS

TECHNICAL FIELD

The present invention relates to the technical field of power supply apparatuses for color lights, and more particularly to a solar cell box for color lights.

BACKGROUND OF THE PRESENT INVENTION

Solar cell boxes for color lights are used to power the color lights, and collect solar energy to achieve the sustainable use of the color lights.

At present, the solar cell box for the color lights on the market includes a box body. The box body includes an upper box cover and a lower box cover detachably connected with the upper box cover. The traditional solar cell box for the color lights generally has a solar charging panel mounted on the surface of the upper box cover. A cell mounting cavity is arranged between the upper and lower box covers. The cell mounting cavity is disposed at the same side as the solar charging panel. Because the cell has a thickness, it is necessary to control the mounting space in the cell mounting cavity. Consequently, after the solar charging panel is mounted, the thickness of the cell box may be increased, and the increase of the thickness may directly increase the transportation cost which is much higher than the material cost, so that the practicability is reduced.

Moreover, the upper box cover and the lower box cover of the traditional cell box are connected directly by bolts, and the traditional assembling mode may allow rainy water or other liquid to enter the cell box, thereby leading to the damage.

SUMMARY OF PRESENT INVENTION

In view of the defects of the prior art, the objective of the present invention is to provide a solar cell box for color lights, which is high in structural rationality, simple in structure and good in waterproof effect.

In order to realize the above objective, the present invention provides the following technical solution: a solar cell box for color lights includes a box body. The box body includes an upper box cover and a lower box cover detachably connected with the upper box cover. The upper box cover is provided with a solar charging panel mounting area for mounting a solar charging panel. The upper box cover and the lower box cover are combined to form a cell mounting cavity. The cell mounting cavity is staggered to the solar charging panel mounting area.

The present invention is further configured as follows: the lower box cover is provided with a water retaining annular plate. A side plate of the upper box cover covers the water retaining annular plate. The outer diameter of the lower box cover is less than the outer diameter of the water retaining annular plate. The side plate of the lower box cover and the water retaining annular plate are of a stepped structure.

The present invention is further configured as follows: an inner side wall of the upper box cover is provided with a retainer ring along the side plate. A mounting groove is formed between the retainer ring and the side plate of the upper box cover. A sealing ring is arranged in the mounting groove.

The present invention is further configured as follows: the thickness of the sealing ring is less than the thickness of the retainer ring, and a ratio between the two is 0.8-0.9.

The present invention is further configured as follows: the side plate of the upper box cover is provided with a wire outlet hole.

The present invention is further configured as follows: the retainer ring is provided with a notch. The notch corresponds to the wire outlet hole.

The present invention is further configured as follows: the water retaining annular plate and the side plate of the upper box cover are parallel to each other, and a distance between the two is 2 mm-3 mm.

By adopting the above technical solution, the present invention has the beneficial effects: 1, by separating the mounting area of the solar charging panel from the mounting area of cells, the assembling thickness can be effectively reduced, and the transportation expense can be controlled within a reasonable range, so that the transportation cost is reduced. A solar charging panel part is staggered to a lithium cell mounting part, so that the safety can also be improved accordingly, the practicability is high, and the structure is simple.

2. The lower box cover is provided with the water retaining annular plate; the side plate of the upper box cover covers the water retaining annular plate; and the outer diameter of the lower box cover is less than the outer diameter of the water retaining annular plate, so that the side plate of the lower box cover and the water retaining annular plate are of a stepped structure. By adopting the above structure, the upper box cover can cover the lower box cover, so that the waterproof effect is improved, the practicability is high, and liquid can be prevented from entering the box body.

3. A good sealing effect is formed between the upper and lower box covers through the sealing ring, so that the practicability is high, and the structure is simple. Moreover, the thickness of the sealing ring is less than the thickness of the retainer ring, so that the mounting groove can form a limiting effect for the lower box cover and also forms a blocking effect for the liquid, thereby improving the waterproof effect, and having high practicability and simple structure.

4. The side plate of the upper box cover is provided with the wire outlet hole, and the retainer ring is provided with the notch. The notch corresponds to the wire outlet hole.

Figure 1:
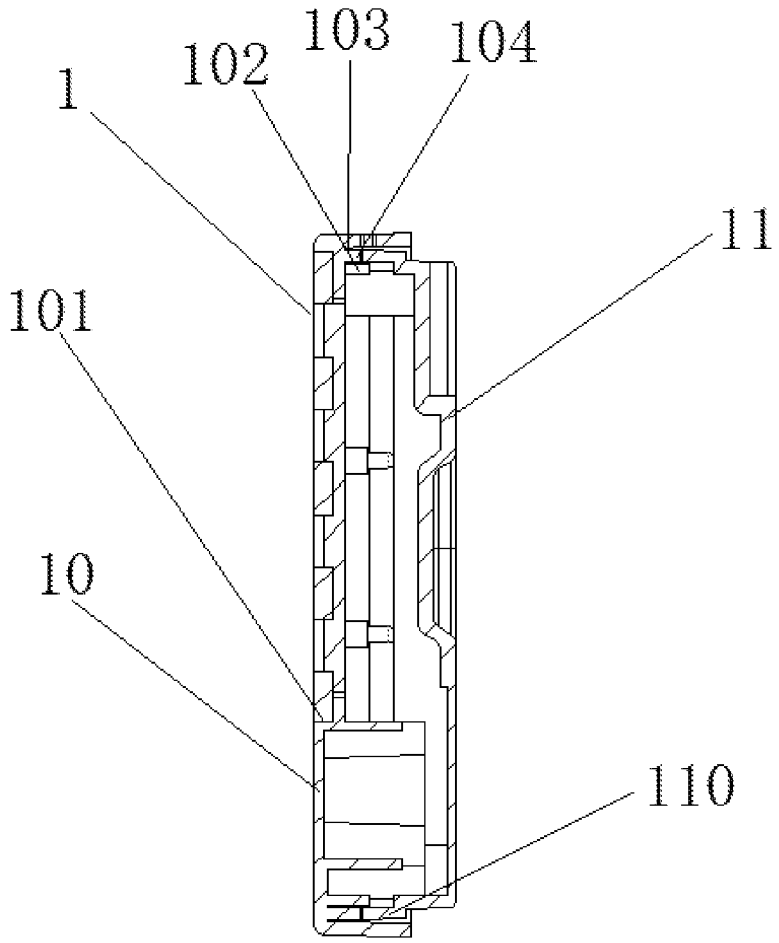
FIG. 1 is a section view of an embodiment of a solar cell box for color lights of the present invention.

Numeral references in the drawing: 1, box body; 10, upper box cover; 102, retainer ring; 103, mounting groove; 104, sealing ring; 105, wire outlet hole; 106, notch; 101, solar mounting area; 11, lower box cover; 110, water retaining annular plate; 12, cell mounting cavity.

DETAILED DESCRIPTION OF PREFERRED EMBODIMENTS

Figure 2:
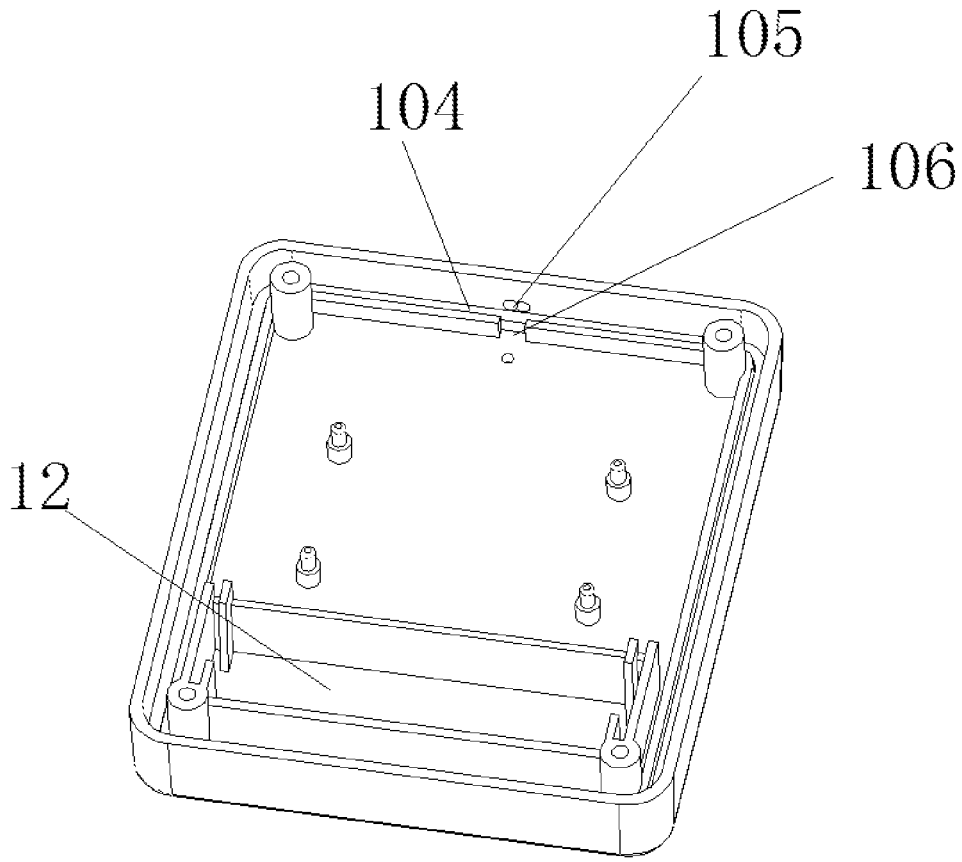
FIG. 2 is a stereoscopic structural diagram of an inner side of an upper box cover of an embodiment of a solar cell box for color lights of the present invention.
Figure 3:
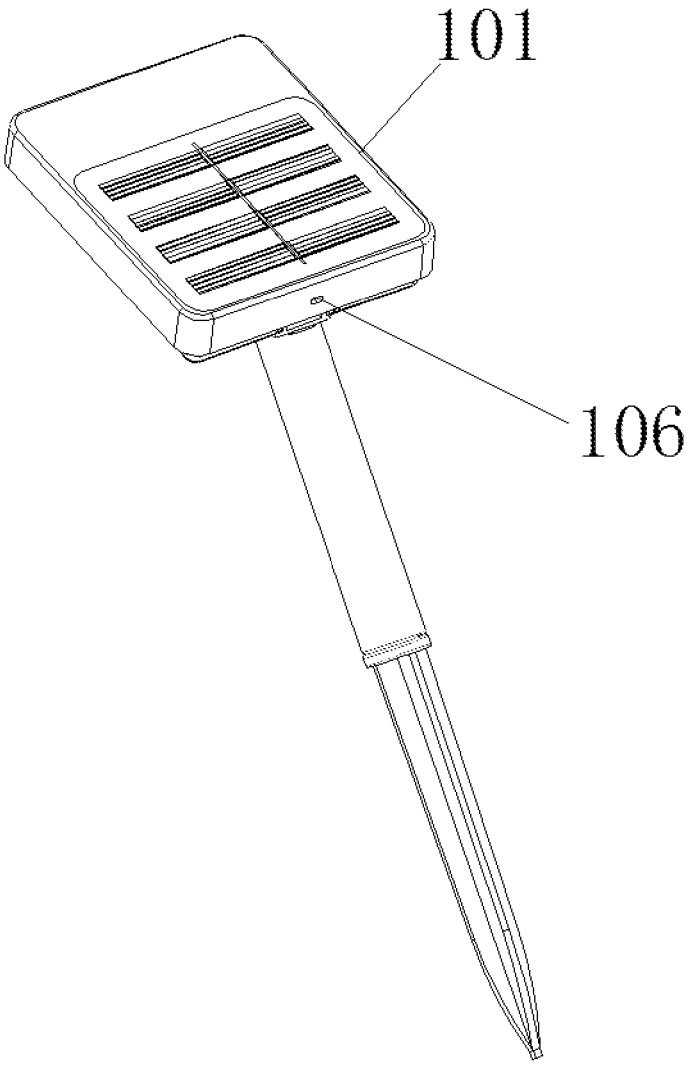
FIG. 3 is a mounting structural diagram of a box body of an embodiment of a solar cell box for color lights of the present invention.

Embodiments of a solar cell box for color lights of the present invention are further described with reference to FIG. 1 to FIG. 3.

For ease of description, the embodiments use spatially relative terms such as "upper", "lower", "left" and "right" to describe a relation between one element or feature and another shown in the drawings. It should be understood that, in addition to the orientations shown in the drawings, the spatial terms are intended to include different orientations of apparatuses in use or operation. For example, if the apparatus in the drawing is inverted, the element that is described as being located "below" other elements or features will be positioned "above" other elements or features. Therefore, the exemplary term "lower" can include both upper and lower positions. The apparatuses may be positioned in other ways (rotated by 90 degrees or in other orientations), and the spatial relative descriptions used herein can be explained accordingly.

Moreover, relational terms such as "first" and "second" are only used to distinguish one component from another component having the same name, and do not necessarily require or imply any such actual relation or sequence between the components.

A solar cell box for color lights includes a box body 1. The box body 1 includes an upper box cover 10 and a lower box cover 11 detachably connected with the upper box cover 10. The upper box cover 10 is provided with a solar charging panel mounting area 101 for mounting a solar charging panel. The upper box cover 10 and the lower box cover 11 are combined to form a cell mounting cavity 12. The cell mounting cavity 12 is staggered to the solar charging panel mounting area 101. By separating the solar charging panel mounting area from the cell mounting area, the assembling thickness can be effectively reduced, and the transportation expense is controlled within a reasonable range, so that the transportation cost is reduced. A solar charging panel part is staggered to a lithium cell mounting part, so that the safety can also be improved accordingly, the practicability is high, and the structure is simple.

The present invention is further configured as follows: the lower box cover 11 is provided with a water retaining annular plate 110; a side plate of the upper box cover 10 covers the water retaining annular plate 110; the outer diameter of the lower box cover 11 is less than the outer diameter of the water retaining annular plate 110; and the side plate of the lower box cover 11 and the water retaining annular plate 110 are of a stepped structure. The lower box cover 11 is provided with the water retaining annular plate 110; the side plate of the upper box cover 10 covers the water retaining annular plate 110; and the outer diameter of the lower box cover 11 is less than the outer diameter of the water retaining annular plate 110, so that the side plate of the lower box cover 11 and the water retaining annular plate 110 are of a stepped structure. By adopting the above structure, the upper box cover 10 can cover the lower box cover 11, so that the waterproof effect can be improved, the practicability is high, and liquid can be prevented from entering the box body.

The present invention is further configured as follows: an inner side wall of the upper box cover 10 is provided with a retainer ring 102 along the side plate; a mounting groove 103 is formed between the retainer ring 102 and the side plate of the upper box cover 10; a sealing ring 104 is arranged in the mounting groove 103; the thickness of the sealing ring 104 is less than the thickness of the retainer ring 102; and the ratio between the two is 0.8-0.9. A good sealing effect is formed between the upper and lower box covers through the sealing ring 104; the practicability is high; and the structure is simple. The thickness of the sealing ring 104 is less than the thickness of the retainer ring 102, so that the mounting groove 103 can form a limiting effect for the lower box cover 11 and also forms a blocking effect for the liquid, so that the waterproof effect is improved, the practicability is high, and the structure is simple.

The present invention is further configured as follows: the side plate of the upper box cover 10 is provided with a wire outlet hole 105, the retainer ring 102 is provided with a notch 106, and the notch 106 corresponds to the wire outlet hole 105. By adopting the above structure, the wire outlet space can be narrowed by the wire outlet hole 105. Moreover, the wire outlet hole 105 is disposed at one side of a mounting end of the box body 1, and the box body 1 is mounted downwardly, so that water can be prevented from entering the water outlet hole 105.

The present invention is further configured as follows: the water retaining annular plate 110 and the side plate of the upper box cover 10 are parallel to each other. By adopting the above structure, the water retaining annular plate 110 is parallel to the side plate of the upper box cover 10, and a distance between the two is 2 mm-3 mm, so that the wire outlet difficulty is alleviated, the mounting stability of the upper box cover and the lower box cover 11 is also improved, the practicability is high, and the structure is simple.

The above only describes preferred embodiments of the present invention and is not intended to limit the present invention. Common changes and substitutions made by those skilled in the art within the technical solution of the present invention shall be included within the protection scope of the present invention.

What is claimed is:

1. A solar cell box, comprising a box body (1) which comprises an upper box cover (10) and a lower box cover (11) detachably connected with the upper box cover (10), wherein the upper box cover (10) is provided with a solar charging panel mounting area (101);

the upper box cover (10) and the lower box cover (11) are combined to form a cell mounting cavity (12); and the cell mounting cavity (12) is staggered to the solar charging panel mounting area (101);

wherein the lower box cover (11) is provided with a water retaining annular plate (110); a side plate of the upper box cover (10) covers the water retaining annular plate (110); the outer diameter of the lower box cover (11) is less than the outer diameter of the water retaining annular plate (110); and the side plate of the lower box cover (11) and the water retaining annular plate (110) are of a stepped structure.

2. The solar cell box according to claim 1, wherein an inner side wall of the upper box cover (10) is provided with a retainer ring (102) along the side plate; a mounting groove is formed between the retainer ring (102) and the side plate of the upper box cover (10); and a sealing ring (104) is arranged in the mounting groove (103).

3. The solar cell box according to claim 2, wherein the thickness of the sealing ring (104) is less than the thickness of the retainer ring (102), and a ratio between the two is 0.8-0.9.

4. The solar cell box according to claim 2, wherein the side plate of the upper box cover (10) is provided with a wire outlet hole (105).

5. The solar cell box according to claim 4, wherein the retainer ring (102) is provided with a notch (106); and the notch (106) corresponds to the wire outlet hole (105).

6. The solar cell box according to claim 5, wherein the water retaining annular plate (110) and the side plate of the upper box cover (10) are parallel to each other, and a distance between the two is 2 mm-3 mm.

* * * * *